US009574753B2

(12) United States Patent
Hwang et al.

(10) Patent No.: US 9,574,753 B2
(45) Date of Patent: Feb. 21, 2017

(54) ILLUMINATION DEVICE THAT SWITCHES LIGHT EMISSION DIRECTION

(71) Applicant: SAMSUNG ELECTRONICS CO., LTD., Suwon-si, Gyeonggi-do (KR)

(72) Inventors: Won-chul Hwang, Bucheon-si (KR); Jung-hyun Park, Suwon-si (KR); Jun-ho Jung, Suwon-si (KR); Hwan-woong Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/672,603

(22) Filed: Mar. 30, 2015

(65) Prior Publication Data

US 2015/0276183 A1 Oct. 1, 2015

(30) Foreign Application Priority Data

Mar. 28, 2014 (KR) ..... 10-2014-0037239
Sep. 25, 2014 (KR) ..... 10-2014-0128374

(51) Int. Cl.

| | |
|---|---|
| ***F21V 17/02*** | (2006.01) |
| ***F21V 21/29*** | (2006.01) |
| ***F21V 11/00*** | (2015.01) |
| *F21Y 101/00* | (2016.01) |

(52) U.S. Cl.

CPC ..... *F21V 17/02* (2013.01); *F21K 9/23* (2016.08); *F21K 9/65* (2016.08); *F21V 11/00* (2013.01); *F21V 21/29* (2013.01); *F21Y 2101/00* (2013.01)

(58) Field of Classification Search

CPC ..... F21V 17/02; F21V 11/00; F21V 21/29; F21K 9/13; F21K 9/1375; F21K 9/58

USPC ..... 362/269, 650, 249.02, 249.03, 249.07,362/249.1

See application file for complete search history.

(56) References Cited

U.S. PATENT DOCUMENTS

| | | | | |
|---|---|---|---|---|
| 4,258,414 | A | 3/1981 | Sokol | |
| 7,695,170 | B1 | 4/2010 | Baldwin et al. | |
| 8,109,660 | B2 * | 2/2012 | Hochstein | F21K 9/00 362/249.03 |
| 2007/0065227 | A1 * | 3/2007 | Sellers | B60G 7/005 403/122 |
| 2009/0323339 | A1 * | 12/2009 | Janos | F21V 21/29 362/249.1 |

(Continued)

FOREIGN PATENT DOCUMENTS

| | | |
|---|---|---|
| EP | 2 442 020 A2 | 4/2012 |
| EP | 2 570 723 A1 | 3/2013 |

(Continued)

OTHER PUBLICATIONS

European Search Report issued Jul. 20, 2015 in corresponding European Patent Application No. 15160859.3.

*Primary Examiner* — Laura Tso
(74) *Attorney, Agent, or Firm* — Staas & Halsey LLP

(57) ABSTRACT

An illumination device includes a conversion unit that controls an emission direction of light emitted from a light-emitting unit included in the illumination device. The conversion unit includes a ball-shaped main body, and may be formed between an upper body, which includes the light-emitting unit, and a lower body. An assembly unit may be formed in the upper body to couple the conversion unit, and the light emission direction may be appropriately controlled by controlling the shape of the ball-shaped main body.

23 Claims, 13 Drawing Sheets

(56) References Cited

U.S. PATENT DOCUMENTS

| | | | | |
|---|---|---|---|---|
| 2011/0019438 | A1* | 1/2011 | Juang | H01R 13/7175 362/647 |
| 2012/0294004 | A1* | 11/2012 | Stathis | F21V 21/26 362/249.1 |
| 2013/0182437 | A1 | 7/2013 | Sachsenweger | |
| 2014/0362593 | A1 | 12/2014 | Kim | |

FOREIGN PATENT DOCUMENTS

| | | |
|---|---|---|
| GB | 2 229 765 | 10/1990 |
| KR | 20-2008-0005009 | 10/2008 |
| KR | 10-2012-0032225 | 4/2012 |
| KR | 10-2013-0097100 | 9/2013 |
| KR | 10-2014-0029692 | 3/2014 |
| WO | WO 2011/132159 A1 | 10/2011 |

* cited by examiner

ILLUMINATION DEVICE THAT SWITCHES LIGHT EMISSION DIRECTION

CROSS-REFERENCE TO RELATED APPLICATIONS

This application claims the benefit of Korean Patent Application No. 10-2014-0037239, filed on Mar. 28, 2014, and Korean Patent Application No. 10-2014-0128374, filed on Sep. 25, 2014, in the Korean Intellectual Property Office, the disclosures of which are incorporated herein in their entireties by reference.

BACKGROUND

1. Field

One or more embodiments relate to an illumination device, and more particularly, to an illumination device that switches a light emission direction.

2. Description of the Related Art

Generally, an illumination device is used for ensuring the ability to see in a dark place or for displaying a visual effect for advertisement or aesthetic purposes. A light source for the illumination device may be an incandescent lamp, a fluorescent lamp, or a halogen lamp. Recently, light-emitting diodes (LEDs) have been used as an illumination device.

LEDs are a kind of light-emitting device that produces light of various colors through changing of a compound semiconductor material, such as GaAs, AlGaAs, GaN, or InGaInP. LEDs have a long lifetime, may be miniaturized and manufactured to have a light weight, and may be driven at a low voltage due to high directionality. Also, LEDs have an excellent monochromatic peak wavelength, an excellent optical efficiency, low power consumption, and are eco-friendly. Therefore, LEDs are widely used in various fields, such as TVs, computers, lighting, and automobiles, and its application fields are gradually expanded.

An illumination device may need a function that the direction of light emitted from a light source is changed to a desired direction after the illumination device is installed. In this case, the light emission direction may be changed by using a direction changing member formed on the same structure on which the illumination device is installed or by changing the direction of a whole structure.

SUMMARY

One or more embodiments include an illumination device having an element that may change an emission direction of light emitted from a light source.

Additional aspects will be set forth in part in the description which follows and, in part, will be apparent from the description, or may be learned by practice of the presented exemplary embodiments.

According to one or more embodiments, an illumination device may include: an upper body on which a light-emitting unit that emits light may be mounted; a lower body that may provide a power path to the light-emitting unit; a conversion unit that may connect the upper body together and the lower body and may convert the emission direction of light emitted from the light-emitting unit of the upper body; and an assembly unit that may assemble the conversion unit to the upper body.

The conversion unit may include a ball-shaped main body unit, the assembly unit may include a first assembly unit and a second assembly unit, and the first and second assembly units may rotate in a state of surrounding and contacting the main body unit.

The conversion unit may include a tap formed by extending from the main body unit, and the tap may be coupled to the lower body by protruding downwards of the upper body.

The conversion unit may include a ball-shaped upper main body and a lower main body, the lower main body may have a larger radius of curvature than that of the upper main body, and a step difference unit may be formed between the lower main body and the upper main body.

At least one conversion control unit that protrudes from the second assembly unit may be formed on a lower surface of the second assembly unit, and the conversion control unit may contact or face an upper surface of the upper main body.

The illumination device may further include at least one protrusion unit formed on the upper main body.

The main body may include a first main body unit, a second main body unit, and a lower surface unit that may be formed between the first and second main body units.

At least one conversion control unit that protrudes from the second assembly unit may be formed on a lower surface of the second assembly unit, and the conversion control unit may contact or face the lower surface unit.

Edge portions that protrude on both sides of the first assembly unit may be supported by a first step difference unit formed of the upper body, and edge portions that protrude on both sides of the second assembly unit may be supported by a second step difference unit of the upper body.

The second assembly unit and the second step difference unit of the upper body may be coupled by at least one assembling means.

The light-emitting unit may be formed by mounting a plurality of diode chips on a substrate.

A cover unit may be formed on the upper body, and the cover unit may be formed, for example, of glass, a ceramic material, a resin of polycarbonate (PC) group, a resin of polymethyl methacrylate (PMMA), or the like.

The upper body may be formed as a housing structure having step differences so that the light-emitting unit and the first and second assembly units may be seated thereon.

The lower body may include a socket unit to supply power to the light-emitting unit from the socket unit.

Edge portions that protrude on both sides of the first assembly unit may be supported by the first step difference unit, and a first elastic member may be formed between the first assembly unit and the first step difference unit.

The illumination device may further include a second elastic member formed between the second assembly unit and the light-emitting unit.

The second elastic member may be formed as an O-ring and may include at least one coil spring.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
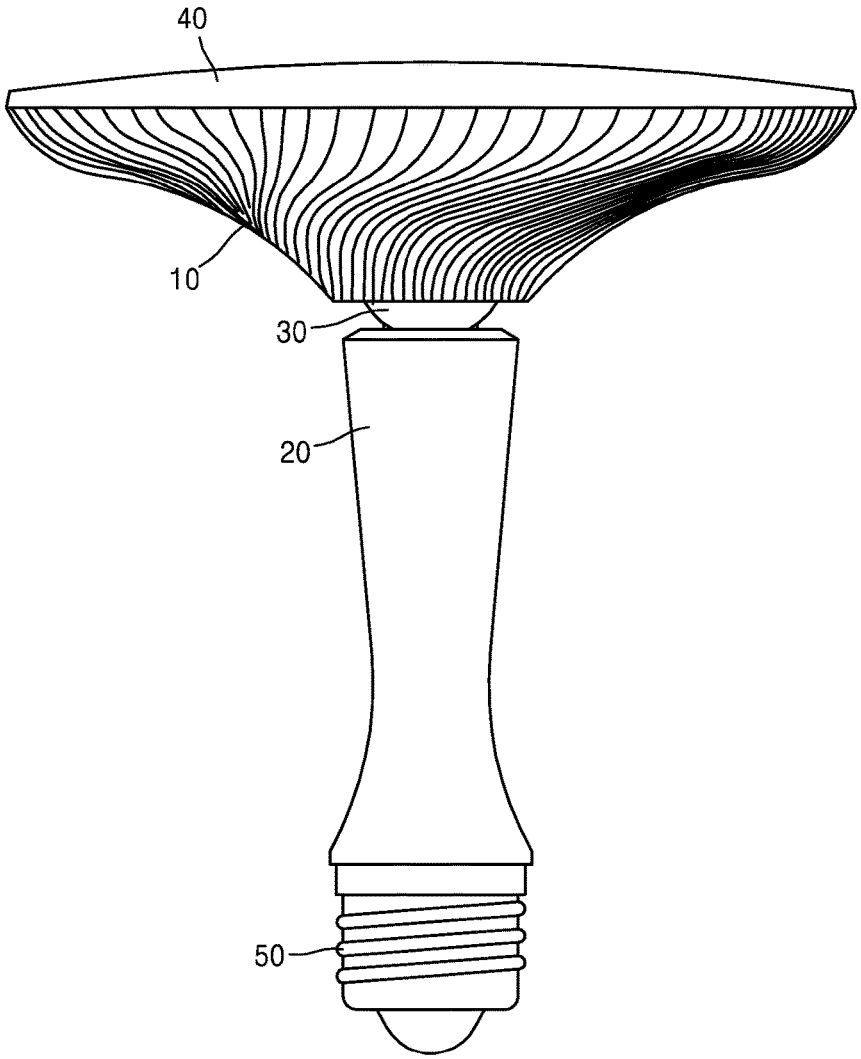
FIG. 1 is a side view of an illumination device according to one or more embodiments.

Reference will now be made in detail to exemplary embodiments, examples of which are illustrated in the accompanying drawings. In the drawings, like reference numerals refer to like elements throughout and the size and thickness of each constituent element may be exaggerated for clarity of explanation. In this regard, embodiments of the present invention may be embodied in many different forms and should not be construed as being limited to embodiments set forth herein. Accordingly, embodiments are merely described below, by referring to the figures, to explain aspects of the present invention.

Figure 2:
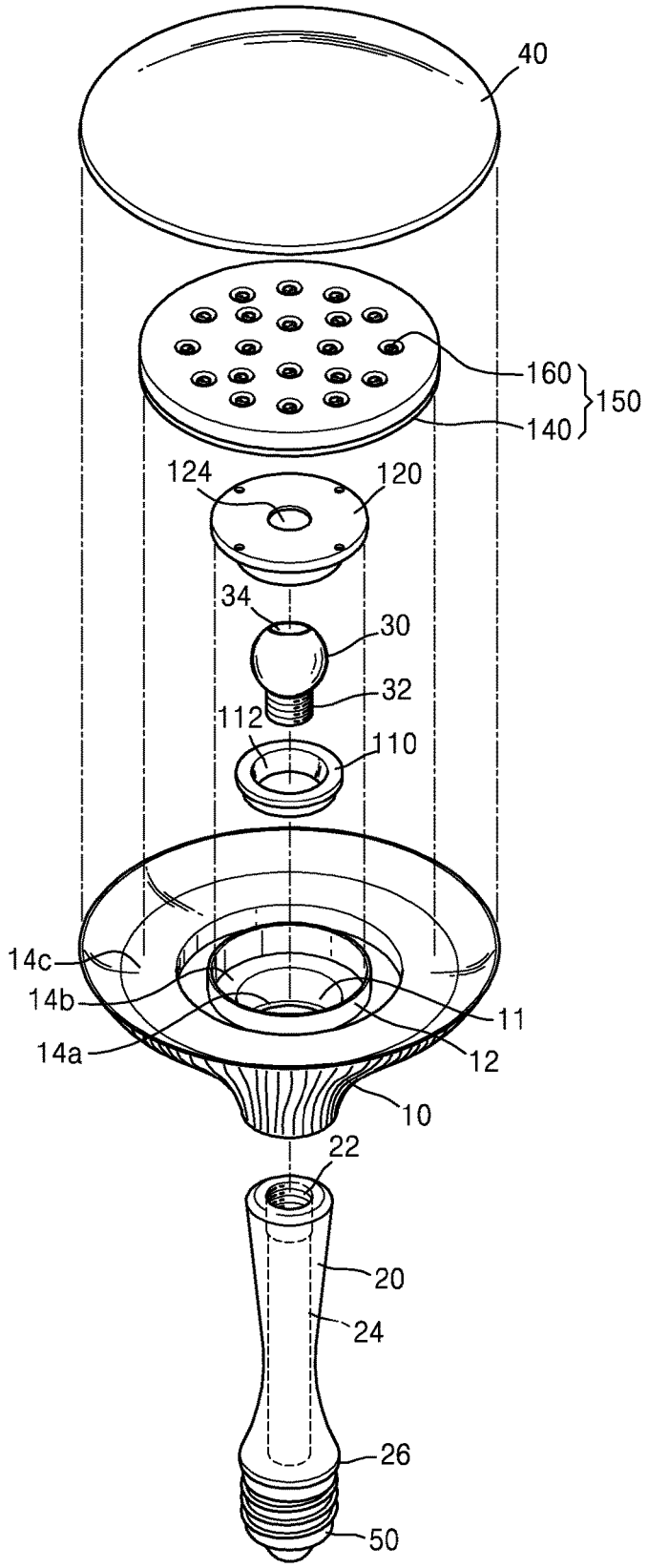
FIG. 2 is an exploded perspective view of an illumination device according to one or more embodiments.

FIG. 1 is a side view of an illumination device according to one or more embodiments. FIG. 2 is an exploded perspective view of according to one or more embodiments such as the illumination device of FIG. 1.

Referring to FIG. 1, the illumination device may include an upper body 10, on which a light-emitting unit that emits light may be mounted, and a lower body 20 that may provide a power path for supplying power to the light-emitting unit and may be connected to another structure via a socket unit 50. A cover unit 40 may be formed on the upper body 10. A conversion unit 30 may be formed between the upper body 10 and the lower body 20. The conversion unit 30 may connect the upper body 10 and the lower body 20 together and may convert the direction of light emitted from the light-emitting unit. The lower body 20 may be fixed on an external structure, and the upper body 10 may rotate or tilt to a desired direction with the conversion unit 30 as a center of rotation.

Referring to FIG. 2, the upper body 10 may include an assembly unit, for example, first and second assembly units 110 and 120, and a light-emitting unit 150 may be mounted on the assembly unit. The assembly unit may include first and second assembly units 110 and 120, and the conversion unit 30 may be coupled between the first and second assembly units 110 and 120. A tap 32, which may be formed on the conversion unit 30, may protrude downwards in the upper body 10 through a through hole 112 of the first assembly unit 110, and thus, may connect the upper body 10 to the lower body 20 by being coupled to a coupling unit 22 of the lower body 20.

Figure 3:
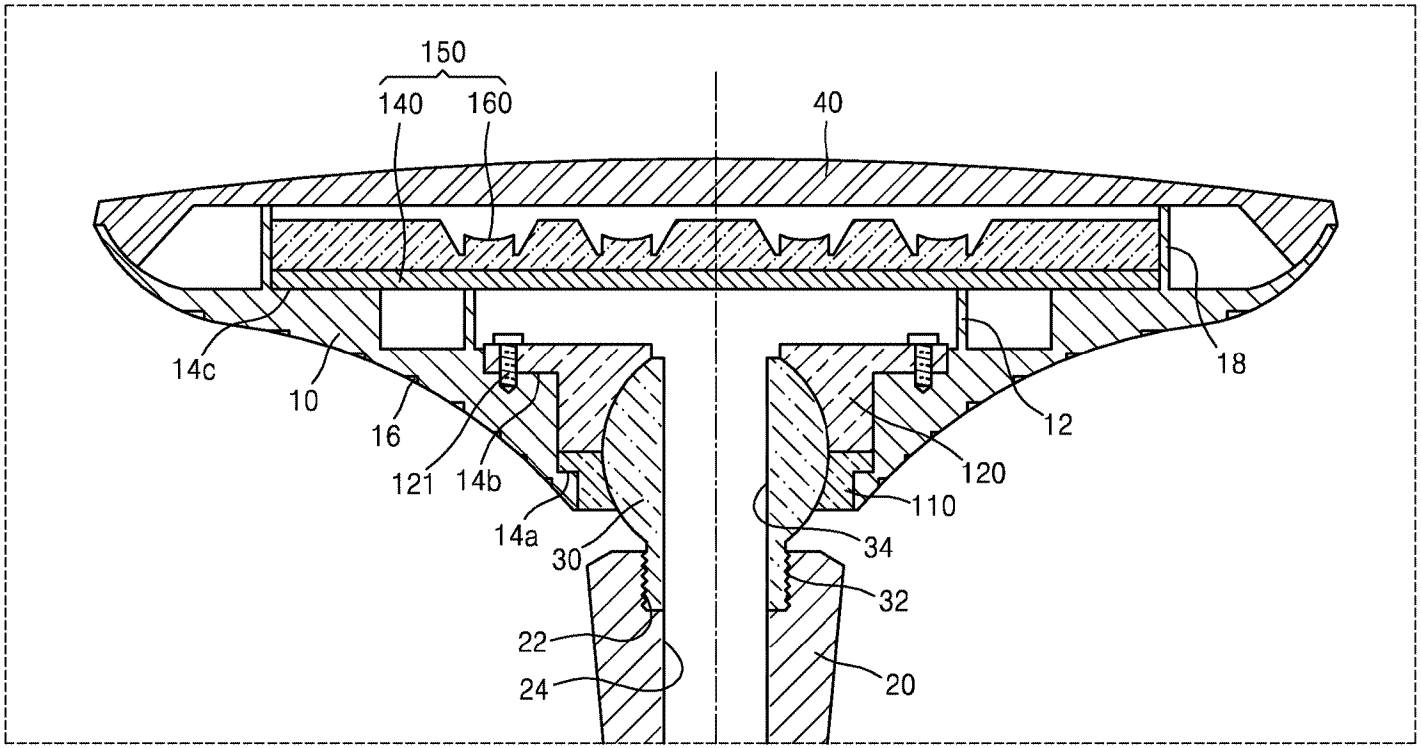
FIG. 3 is a cross-sectional view of an assembled structure of an illumination device such as the illumination device of FIG. 1, according to one or more embodiments.

FIG. 3 is a cross-sectional view of an assembled structure of an illumination device such as the illumination device of FIG. 1, according to one or more embodiments.

Referring to FIGS. 2 and 3, a step difference unit, for example, first, second, and third step difference units 14*a*, 14*b*, and 14*c*, may be provided in the upper body 10 to support and seat the first and second assembly units 110 and 120, the conversion unit 30, and the light-emitting unit 150.

Both edges that protrude on both sides of the first assembly unit 110 may be positioned on the upper body 10 by being supported by the first step difference unit 14*a*. A coupling means, for example, an adhesive may be optionally used between the first assembly unit 110 and the upper body 10. However, the first assembly unit 110 may be seated on the upper body 10 without using an additional coupling means. The conversion unit 30 may be inserted into the through hole 112 in the first assembly unit 110, and the tap 32 formed on the conversion unit 30 may protrude outside, that is, downwards in the through hole 112 of the first assembly unit 110. The tap 32 of the conversion unit 30 may be coupled to the coupling unit 22 of the lower body 20, and spirals may be formed on surfaces of the tap 32 and the coupling unit 22 to correspond to each other and readily couple to each other.

The second assembly unit 120 may be located on the first assembly unit 110 and the conversion unit 30, edge portions that protrude on both sides of the second assembly unit 120 may be supported by the second step difference unit 14*b*. A fastener 121 may be used between the second assembly unit 120 and the upper body 10, for example, the both edges of the second assembly unit 120 and the second step difference unit 14*b* may be coupled by the fastener 121 having a spiral formed thereon. Also, optionally, the both edges of the second assembly unit 120 and the second step difference unit 14*b* may be coupled by using an adhesive. More than one fastener 121 may be used between the second assembly unit 120 and the upper body 10. When a binding force between the second assembly unit 120 and the upper body 10 is weak, the second assembly unit 120 and the upper body 10 may be separated from each other. In this case, the conversion unit 30 may be moved upwards. Therefore, a plurality of fasteners 121 may be formed between the first and second assembly units 110 and 120 and the upper body 10. The first and second assembly units 110 and 120 may both surround and contact the ball-shaped conversion unit 30 and may rotate with the conversion unit 30 as a center of rotation. The light-emitting unit 150 may be located on the third step difference unit 14*c* of the upper body 10. In order to dissipate heat generated from the light-emitting unit 150 to the outside, a contact area between the third step difference unit 14*c* of the upper body 10 and the light-emitting unit 150 may be controlled or an additional contact area may further be formed. An external surface 16 of the upper body 10 may have various shapes, for example, may have a wave shape.

In the case of the illumination device according to one or more embodiments, a light-emitting diode (LED), an incandescent lamp, a fluorescent lamp, or a halogen lamp may be used as a light source, and there are not specific limitations. In one or more embodiments, an LED may be used as a light source. The light-emitting unit 150 may include an LED 160 mounted on a substrate 140. For example, the LED 160 may be mounted on the substrate 140 after packaging at least one of an LED chip by a free-mold method using a lead frame, a mold frame, a fluorescent substance, or a transparent filler, for example. Also, the LED 160 may be mounted on the substrate 140 by mounting a plurality of LED chips by using a wire bonding method or a flip-chip bonding method, for example. The substrate 140 may be a printed circuit board (PCB), for example, and may be a circuit substrate having a metal substrate or a metal core to possibly improve heat dissipation characteristics. The light-emitting unit 150 may receive power by being electrically connected to the socket unit 50, for example, the substrate 140 and the socket unit 50 may be connected via a wire. Through holes 11, 24, and 34 may be respectively formed through the upper body 10, the lower body 20, and the conversion unit 30 between the light-emitting unit 150 and the socket unit 50 to provide a power path of a power supply element. Also, through holes 112 and 124 for assembling the conversion unit 30 and providing a power path of a power supply element may be respectively formed in the first and second assembly units 110 and 120.

The cover unit 40 may be, for example, a dome-type transparent cover or the like, and may cover the light-emitting unit 150 by being coupled with the upper body 10. The cover unit 40 may function as a lens and may be a diffusion cover that diffusively reflects and diffusively transmits light. Also, the cover unit 40 may function to keep the shape of the light-emitting unit 150 and also to protect the light-emitting unit 150. The cover unit 40 may be formed of a transparent material that transmits light emitted from the light-emitting unit 150. For example, the cover unit 40 may be formed of a ceramic material, such as glass or alumina ($Al_2O_3$), a polycarbonate (PC) group resin material, or a polymethyl methacrylate (PMMA) group resin material, or the like. Also, in order to increase the thermal conductivity of the cover unit 40, a filler may be added to the glass, the PC group resin material, or the PMMA group resin material. Examples of the filler may be particles of carbon nanotube and graphene, and also, may be particles of titan oxide, zinc oxide, zirconium oxide, aluminum nitride, or aluminum oxide, or the like. The cover unit 40 may be formed, for example, by using a molding method, such as an injection molding method and a blow molding method.

The upper body 10 may include the first assembly unit 110, the second assembly unit 120, and the light-emitting unit 150 therein, and may be formed as a housing structure having step differences so that the first assembly unit 110, the second assembly unit 120, and the light-emitting unit 150 may be seated. The first, second, and third step difference units 14*a*, 14*b*, and 14*c* and guide units 12 and 18 may be formed in the upper body 10 so that constituent elements may be mounted. The upper body 10 may stably support the light-emitting unit 150, and may include a heat dissipation member to readily dissipate heat generated from the LEDs 160 to the outside. For example, a protrusion unit having various patterns may be formed on the external surface 16 of the upper body 10 to increase heat dissipation efficiency. The upper body 10 may be formed of a material having high thermal conductivity. For example, the upper body 10 may be formed of a metal, such as aluminum or resin in which a thermal conductive filler may be dispersed.

The lower body 20 may have a through hole 24 therein to provide a power path for passing a cable for supplying power to the light-emitting unit 150. The socket unit 50 may be coupled to a lower edge 26 of the lower body 20, and the connection unit 22 may be formed on an upper inner edge of the lower body 20 so that the tap 32 of the conversion unit 30 may be coupled with the connection unit 22. Materials for forming the lower body 20 are not specifically limited. For example, the lower body 20 may be formed of various types of synthetic resins and metals, and the like. The lower body 20 may be coupled to an external structure directly or via the socket unit 50.

Figure 4A:
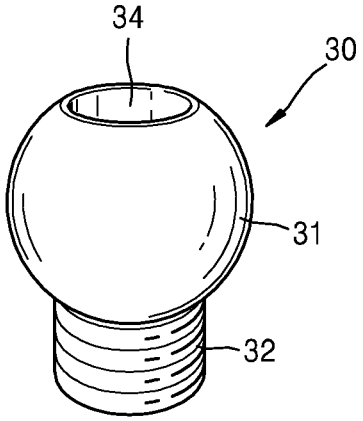
FIG. 4A is a perspective view of a conversion unit of an illumination device such as the illumination device, according to one or more embodiments.

FIG. 4A is a perspective view of a conversion unit of an illumination device such as the illumination device, according to one or more embodiments.

Referring to FIG. 4A, the conversion unit 30 may include a ball-shaped main body unit 31 and the tap 32 formed by extending from the main body unit 31. The main body unit 31 may not necessarily be a complete ball shape. The conversion unit 30 may include the through hole 34 to provide a power path for passing a power supply means that may supply power to the light-emitting unit 150. The main body unit 31 of the conversion unit 30 may contact inner surfaces of the first and second assembly units 110 and 120. A contact position between the main body unit 31 and the first and second assembly units 110 and 120 may be changed by sliding motion between the main body unit 31 and the first and second assembly units 110 and 120. Accordingly, the direction of light emitted from the light-emitting unit 150 may be changed. Since the conversion unit 30 may have a contact position with the first and second assembly units 110 and 120, the conversion unit 30 may be formed of a material that does not easily wear. The conversion unit 30 may be formed of, for example, a metal, plastic, or a synthetic resin, or the like. The conversion unit 30 may be formed of, for example, a metal, such as aluminum, and a surface thereof may be optionally gloss treated.

Figure 4B:
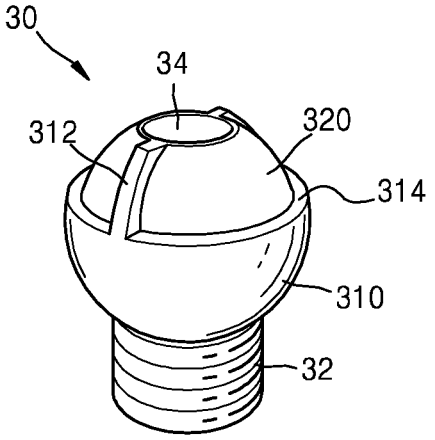
FIG. 4B is a perspective view of a modified example of a conversion unit of an illumination device according to one or more embodiments such as the conversion unit of FIG. 4A.

FIG. 4B is a perspective view of a modified example of a conversion unit of an illumination device according to one or more embodiments such as the conversion unit of FIG. 4A.

Referring to FIG. 4B, the conversion unit 30 may include a ball-shaped main body unit, for example, lower and upper main bodies 310 and 320. The lower main body 310 may have a larger radius of curvature than that of the upper main body 320. The conversion unit 30 may not necessarily be a complete ball shape, and may be a combination of two types of domes having different radiuses of curvatures. A step difference unit 314 may be formed on a region where the lower main body 310 and the upper main body 320 of the conversion unit 30 meet each other in a case where the lower main body 310 has a greater width than that of the upper main body 320. A protrusion unit 312 may be formed on the upper main body 320, and the protrusion unit 312 may be a portion formed by extending from the lower main body 310 towards the upper main body 320. A position conversion angle of the second assembly unit 120 that contacts the conversion unit 30 may be determined by the protrusion unit 312 and the step difference unit 314.

Figure 4C:
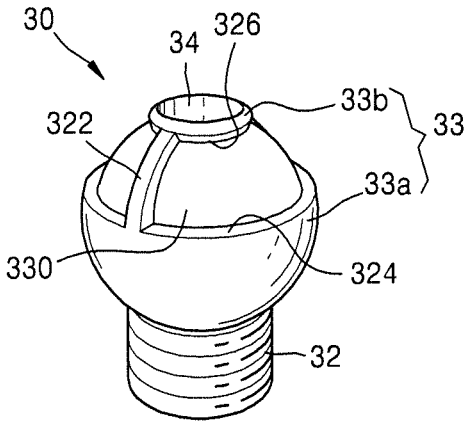
FIG. 4C is a perspective view of another modified example of a conversion unit of an illumination device according to one or more embodiments such as the conversion unit of FIG. 4A.

FIG. 4C is a perspective view of another modified example of a conversion unit of an illumination device according to one or more embodiments such as the conversion unit of FIG. 4A.

Referring to FIG. 4C, the conversion unit 30 may include a ball-shaped main body unit 33. The main body unit 33 may include a first main body unit 33*a*, a second main body unit 33*b*, and a lower surface unit 330 formed between the first main body unit 33*a* and the second main body unit 33*b*. The lower surface unit 330 may be a region having a surface that is lower than surfaces of the first main body unit 33*a* and the second main body unit 33*b*. The lower surface unit 330 may be a region having a smaller radius of curvature than that of the first main body unit 33*a* or the second main body unit 33*b*. Step difference units 324 and 326 may be respectively formed between the lower surface unit 330 and the first main body unit 33*a* and between the lower surface unit 330 and second main body unit 33*b*. The lower surface unit 330 may include a protrusion unit 322 that protrudes from the lower surface unit 330, and the protrusion unit 322 may be a region formed by extending from the first main body unit 33*a* and the second main body unit 33*b* of both sides of the lower surface unit 330. A range of contact position of the second assembly unit 120 that contacts the conversion unit 30 may be controlled by the step difference units 324 and 326 of both sides of the lower surface unit 330 and the protrusion unit 322.

Figure 5:
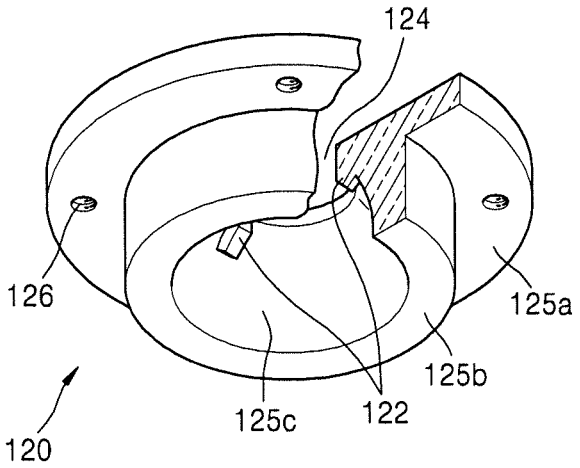
FIG. 5 is a perspective view of a second assembly unit of the illumination device, according to one or more embodiments.

FIG. 5 is a perspective view of the second assembly unit 120 of the illumination device, according to one or more embodiments.

Referring to FIG. 5, both edge portions of the second assembly unit 120 may be supported by the second step difference unit 14*b* of the upper body 10. A surface of the second assembly unit 120 that contacts the second step difference unit 14*b* may be a first lower surface 125*a*. At least one hole 126 for inserting the fastener 121 (refer to FIG. 3) may be formed in the first lower surface 125*a* of the second assembly unit 120 so that the second assembly unit 120 may be coupled to the second step difference unit 14*b* of the upper body 10. A second lower surface 125*b* of the second assembly unit 120 may contact or face an upper surface of the first assembly unit 110.

A third lower surface 125*c* of the second assembly unit 120 may contact a portion of a region of the main body 31 of the conversion unit 30 (refer to FIG. 4A) or the lower main body 310 of the conversion unit 30 (refer to FIG. 4B). The third lower surface 125*c* of the second assembly unit 120 may be formed to have a curvature so that the third lower surface 125*c* has a shape corresponding to the main body unit 31 of the conversion unit 30. Also, in the case of the first assembly unit 110, a region of the first assembly unit 110 that contacts the conversion unit 30 may be formed to have a curvature corresponding to the shape of the surface of the conversion unit 30. The first and second assembly units 110 and 120 may be formed of a material having a small friction coefficient, an anti-wearable property, and elasticity since the first and second assembly units 110 and 120 change a contact position when the first and second assembly units 110 and 120 are in contact with the conversion unit 30. The first and second assembly units 110 and 120 may be formed of a material, such as polymer or rubber or the like. For example, the first and second assembly units 110 and 120 may be formed of acetal. At least one conversion control unit 122 that protrudes from the third lower surface 125*c* may be formed on the third lower surface 125*c* of the second assembly unit 120. When the conversion unit 30 having a shape as depicted in FIG. 4B or 4C is used, the conversion control unit 122 may be formed to set a rotation range of the second assembly unit 120 that contacts the conversion unit 30. The position of the conversion control unit 122 may be controlled within the third lower surface 125*c* of the second assembly unit 120. The conversion control unit 122 may contact or face the surface of the conversion unit 30.

Figure 6A:
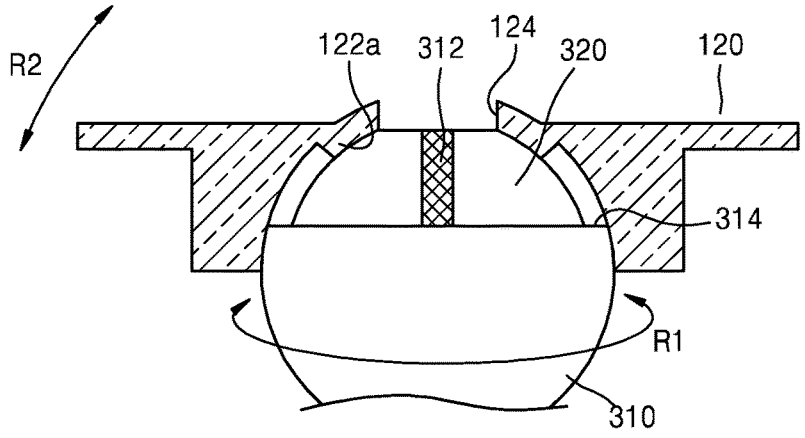
FIG. 6A is a cross-sectional view of a coupling relationship between a conversion unit according to one or more embodiments such as the conversion unit of FIG. 4B and a second assembly unit.

FIG. 6A is a cross-sectional view of a coupling relationship between a conversion unit according to one or more embodiments such as the conversion unit 30 of FIG. 4B and an assembly unit according to one or more embodiments such as the second assembly unit 120 of FIG. 5.

Referring to FIGS. 4B, 5, and 6A, some regions of the third lower surface 125*c* of the second assembly unit 120 may contact the lower main body 310 of the conversion unit 30 and may be separate from a surface of the upper main body 320. When an angle of the second assembly unit 120 is changed with the conversion unit 30 as a center, the conversion control unit 122 may move in a contact state or a separated state with a surface of the upper main body 320 of the conversion unit 30. When the conversion control unit 122 meets the step difference unit 314 of the conversion unit 30 or the protrusion unit 312 of the upper main body 320, the conversion control unit 122 may act as a stopper to stop the direction conversion, and set a limiting value of the direction conversion of the second assembly unit 120.

As depicted in FIG. 6A, when the second assembly unit 120 rotates in an R1 direction, the rotation in the R1 direction may be stopped when the conversion control unit 122 of the second assembly unit 120 meets the protrusion unit 312. Also, when the second assembly unit 120 rotates in an R2 direction, the rotation in the R2 direction may be stopped when the conversion control unit 122 meets the step difference unit 314 of the conversion unit 30. If the conversion control unit 122 and the protrusion unit 312 are not formed, the second assembly unit 120 may rotate at an angle of 360° or greater in the R1 direction. However, if the need for rotating at such a large angle is low, the protrusion unit 312 may be formed on the conversion unit 30. At least one protrusion unit 312 may be formed on the upper main body 320 of the conversion unit 30. The amount of rotation in the R2 direction may be determined according to a gap or angle between the step difference unit 314 of the conversion unit 30 to the conversion control unit 122 of the second assembly unit 120. If the conversion unit 30 is formed in the shape depicted in FIG. 4B, the upper body 10 may rotate in the R2 direction until a lower edge of the upper body 10 meets an upper edge of the lower body 20.

Figure 6B:
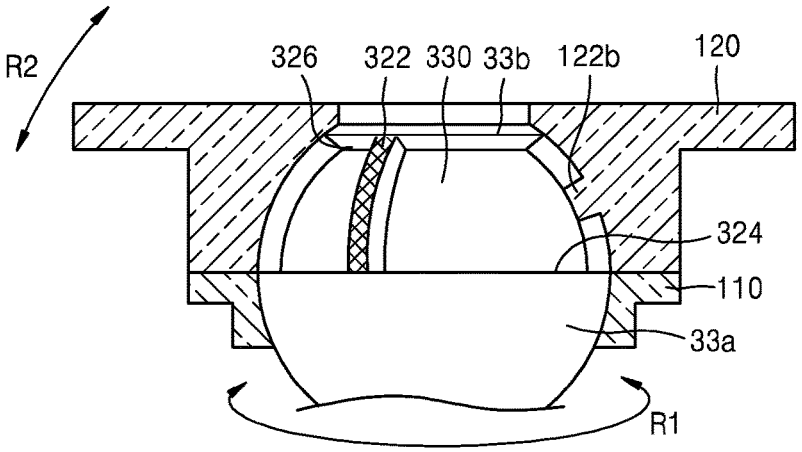
FIG. 6B is a cross-sectional view of a coupling relationship between a conversion unit according to one or more embodiments such as the conversion unit of FIG. 4C and a first and a second assembly unit.

FIG. 6B is a cross-sectional view of a coupling relationship between the conversion unit 30 of FIG. 4C and the first and second assembly units 110 and 120.

Referring to FIGS. 4C, 5, and 6B, the first and second assembly units 110 and 120 may contact the first and second main body units 33*a* and 33*b*. In the case of the second assembly unit 120, the second assembly unit 120 may contact the second main body unit 33*b* of the lower surface unit 330 while being separate from the lower surface unit 330. When an angle of the second assembly unit 120 is changed with the conversion unit 30 as a center, the conversion control unit 122*a* may be moved in a contact state or a non-contact sate with a surface of the lower surface unit 330. When the second assembly unit 120 rotates in the R1 direction, the rotation of the conversion control unit 122*b* may be stopped by contacting the protrusion unit 322. Also, when the second assembly unit 120 rotates in the R2 direction, the rotation of the conversion control unit 122*b* may be stopped by contacting the step difference units 324 and 326. Accordingly, the conversion control unit 122*b* may function as a stopper.

Figure 7A:
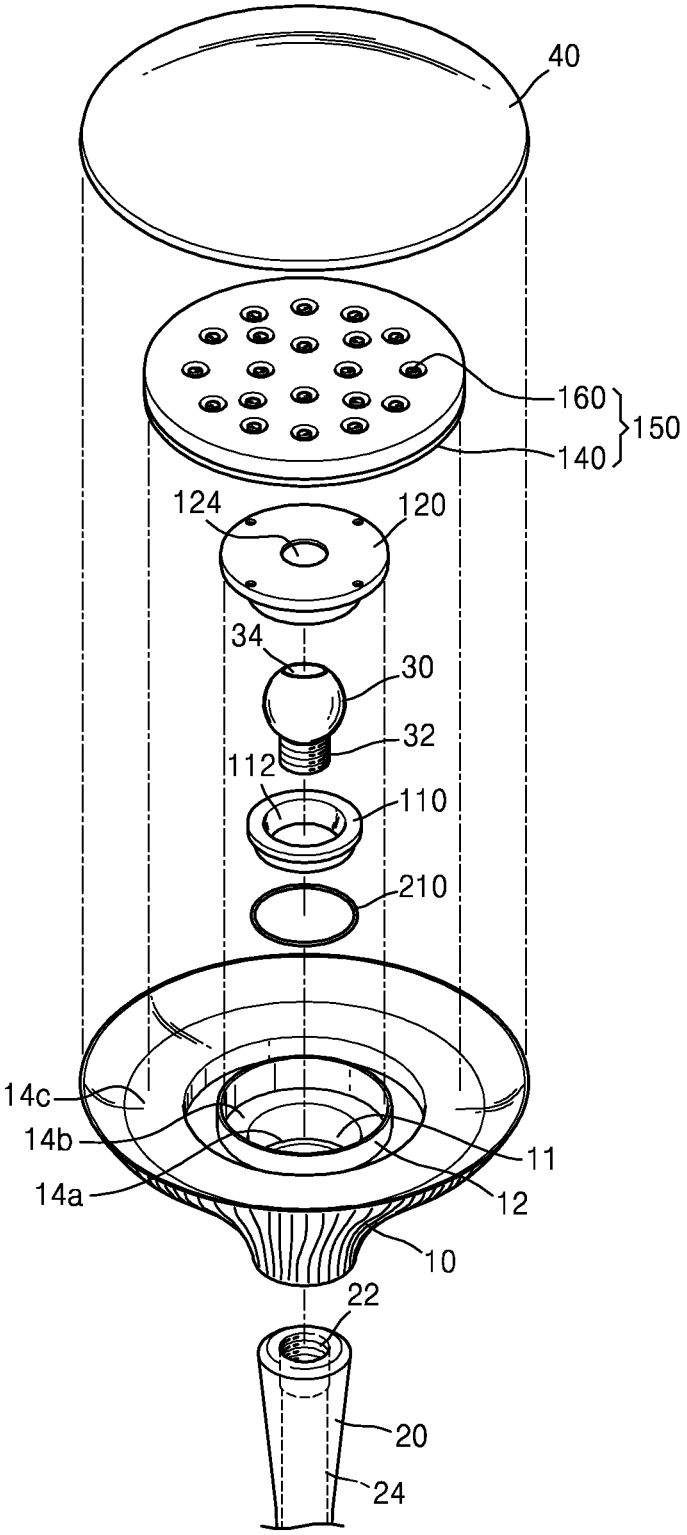
FIG. 7A is an exploded perspective view of a structure that includes an elastic member formed between an upper body and a first assembly unit in an illumination device according to one or more embodiments.
Figure 7B:
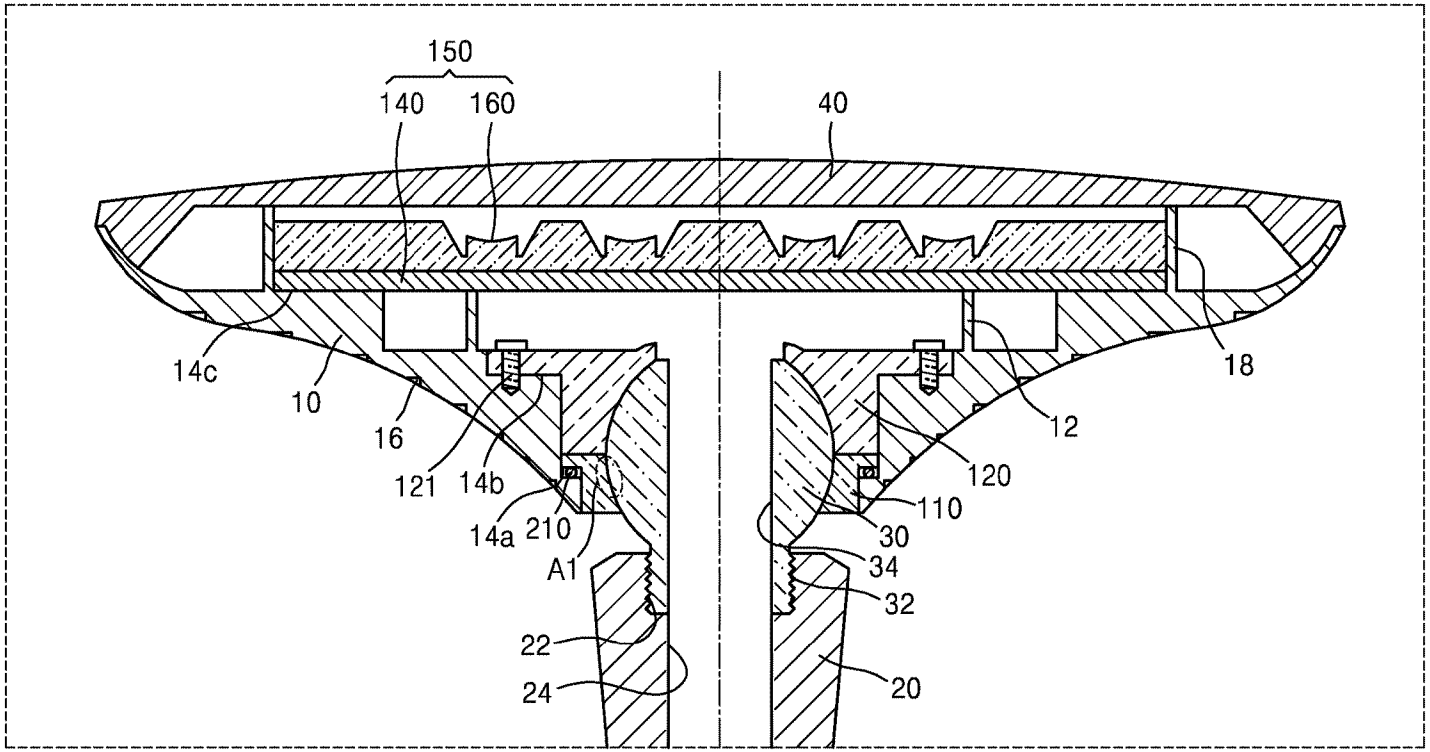
FIG. 7B is a cross-sectional view of an assembled structure of an illumination device such as the illumination device of FIG. 7A, according to one or more embodiments.

FIG. 7A is an exploded perspective view of a structure that includes an elastic member formed between the upper body 10 and a first assembly unit 110 in an illumination device according to one or more embodiments. FIG. 7B is a cross-sectional view of an assembled structure of an illumination device such as the illumination device of FIG. 7A, according to one or more embodiments.

Referring to FIGS. 7A and 7B, when the first assembly unit 110 is seated on the first step difference unit 14*a* in the upper body 10, a first elastic member 210 may be inserted between the first assembly unit 110 and the first step difference unit 14*a*. The conversion unit 30 may perform a rotational motion when the conversion unit 30 is in contact with the first and second assembly units 110 and 120, and may perform a large number of rotational motions, in particular, for a long time, at a region A1 between the conversion unit 30 and the first and second assembly units 110 and 120. In this case, a minute gap may be formed between the conversion unit 30 and the first assembly unit 110 due to the friction between the conversion unit 30 and the first assembly unit 110 or between the conversion unit 30 and the second assembly unit 120. At this point, when the upper body 10 controls an angle by rotating with the conversion unit 30 as a center, tension that may maintain a desired angle of the upper body 10 may be insufficient. However, when the first elastic member 210 is formed between the first assembly unit 110 and the first step difference unit 14*a*, the first assembly unit 110 may have a restoration force corresponding to the pressing force of the first assembly unit 110 to the first elastic member 210. Accordingly, since the first elastic member 210 is formed between the conversion unit 30 and the first assembly unit 110, although there is friction between the conversion unit 30 and the first assembly unit 110, the occurrence of the gap may be prevented, and thus, a certain tension for maintaining a desired angle of the upper body 10 may be provided.

The first elastic member 210 is formed between the first step difference unit 14*a* of the upper body 10 and the first assembly unit 110, and thus, may have a circular shape. The first elastic member 210 may have a size and a circumference suitable for seating on the first step difference unit 14*a* and may have, for example, an O-ring shape. The first elastic member 210 may be formed of various materials, for example, teflon, rubber, polymer, or silicon, but is not limited thereto.

Figure 8A:
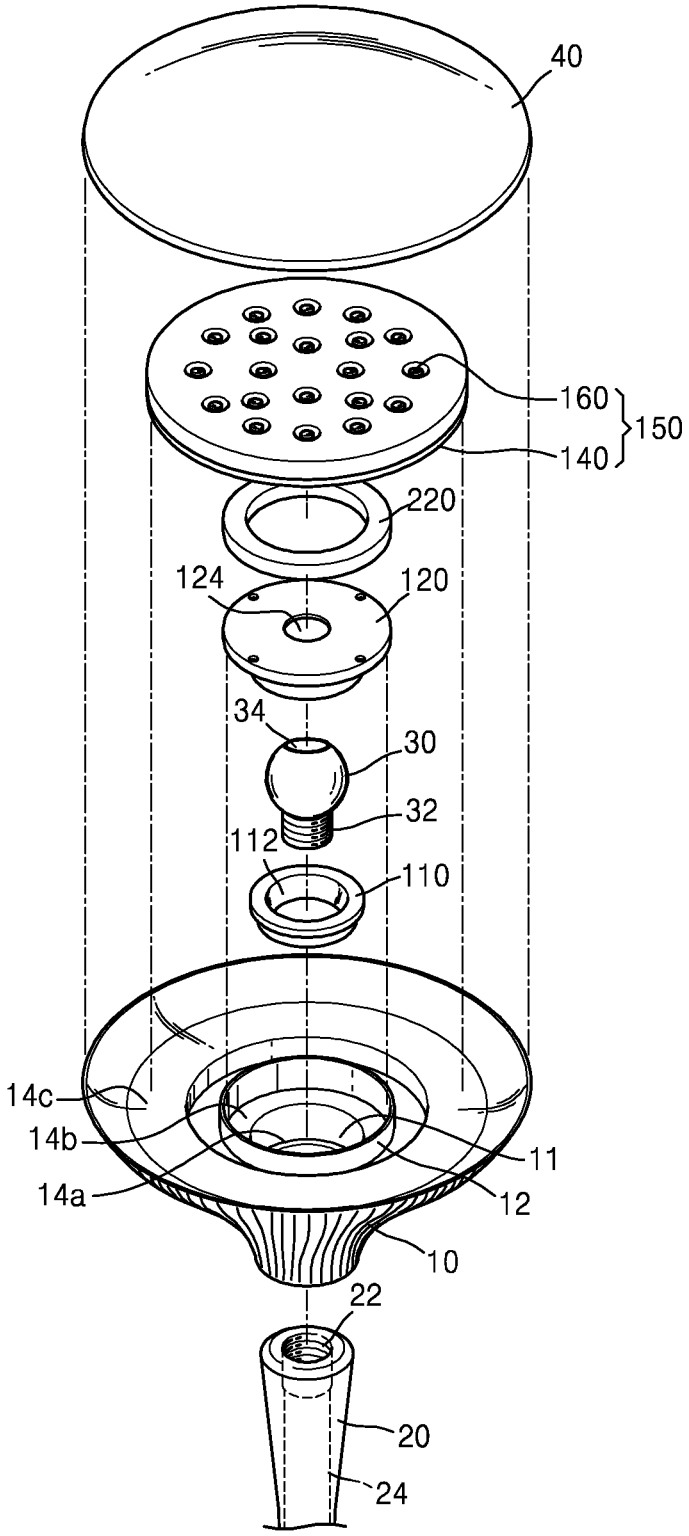
FIG. 8A is an exploded perspective view of a structure that includes an elastic member formed between a second assembly unit and an illumination unit in an illumination device according to one or more embodiments.

FIG. 8A is an exploded perspective view of a structure that includes an elastic member formed between a second assembly unit 120 and an illumination unit in an illumination device according to one or more embodiments.

Referring to FIG. 8A, the first assembly unit 110 may be seated on the first step difference unit 14*a* in the upper body 10, the conversion unit 30 may be positioned on the first assembly unit 110, and the second assembly unit 120 may surround an upper edge of the conversion unit 30 and may be fixed on the second step difference unit 14*b* of the upper body 10. The light-emitting unit 150 may be positioned on the second assembly unit 120, and the light-emitting unit 150 may be seated on the third step difference unit 14*c* of the upper body 10. A second elastic member 220 may be inserted between the second assembly unit 120 and the light-emitting unit 150.

The second elastic member 220 may prevent the occurrence of a minute gap between the conversion unit 30 and the first assembly unit 110 due to friction between the conversion unit 30 and the first assembly unit 110 or between the conversion unit 30 and the second assembly unit 120. When the upper body 10 controls an angle by rotating with the conversion unit 30 as a center, like the first elastic member 210, the second elastic member 220 may provide tension for maintaining a desired angle of the upper body 10. The second elastic member 220 may have various shapes, such as a disc spring 230. The disc spring 230 may be formed, for example, of a metal, a polymer, or rubber, or the like.

Figure 8B:
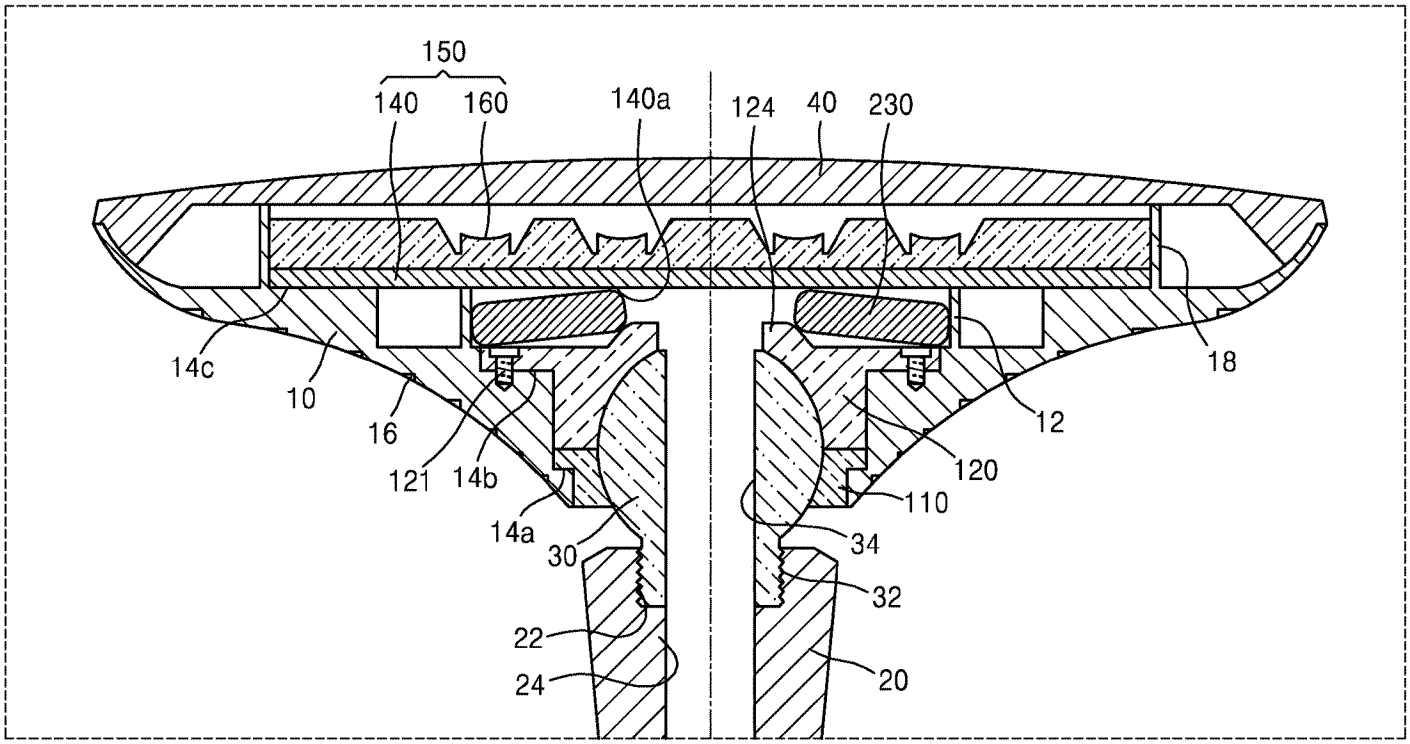
FIGS. 8B through 8D are cross-sectional views of various examples of elastic members included in an illumination device according to one or more embodiments.
Figure 8C:
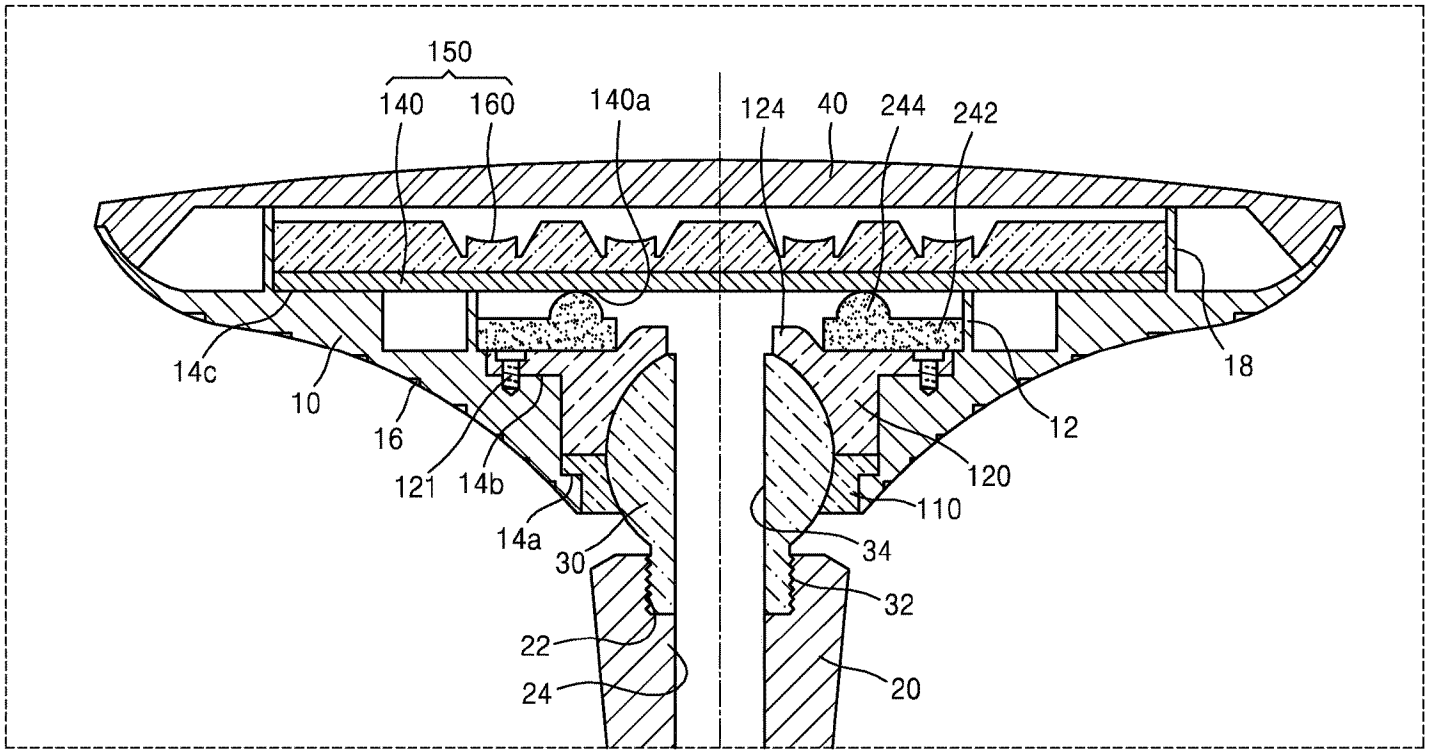
Figure 8D:
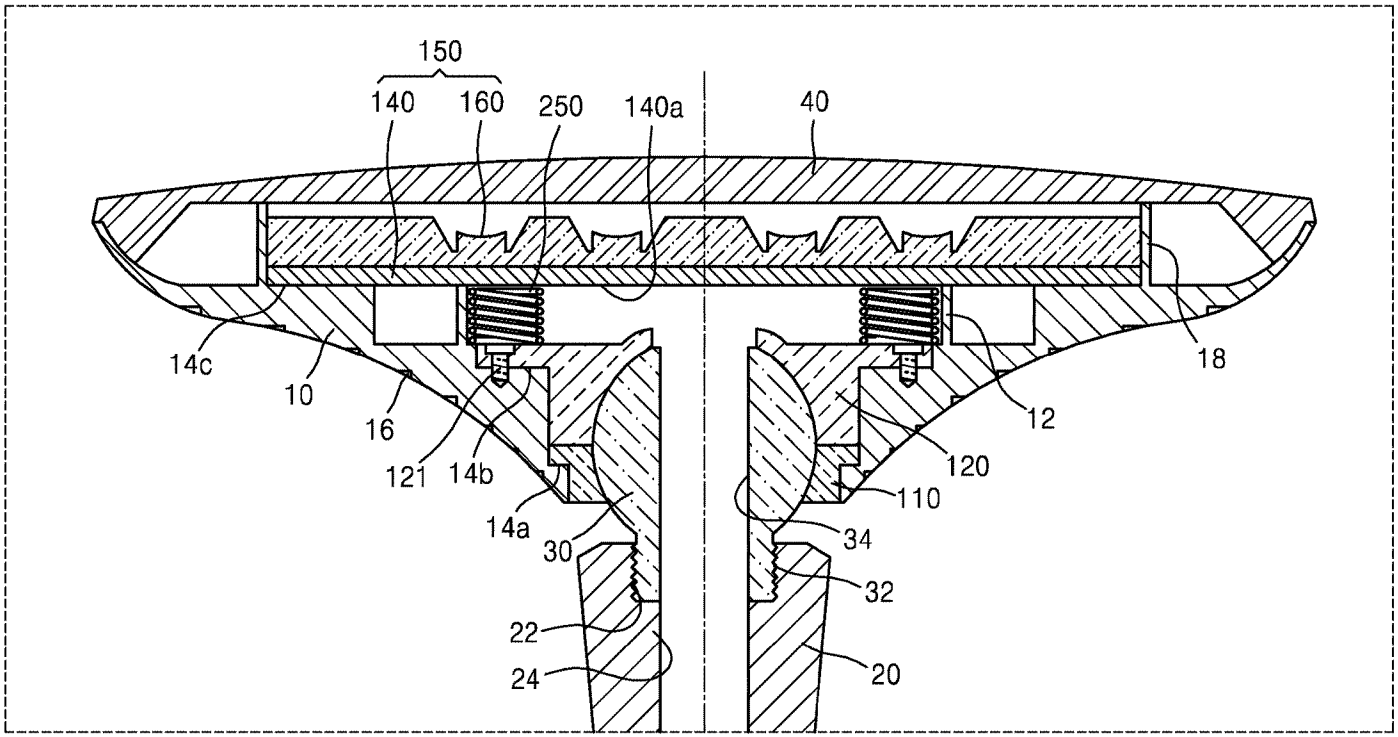

FIGS. 8B through 8D are cross-sectional views of various examples of elastic members included in an illumination device according to an exemplary embodiment.

Referring to FIGS. 8A and 8B, the second elastic member 220 may be formed in a disc spring shape or a discus shape having a hole therein. An upper inner part of the disc spring 230 may contact a lower surface 140*a* of the light-emitting unit 150 and an outer lower part of the disc spring 230 may contact an upper surface of the second assembly unit 120. On the other hand, an outer lower part of the disc spring 230 may contact the lower surface 140*a* of the light-emitting unit 150 and a lower inner part of the disc spring 230 may contact an upper surface of the second assembly unit 120; however, the shape thereof is not limited thereto. Since the disc spring 230 is formed between the second assembly unit 120 and the light-emitting unit 150, tension between the second assembly unit 120 and the light-emitting unit 150 may be maintained. The disc spring 230 may be formed of, for example, a metal, a polymer, or rubber, or the like.

Referring to FIGS. 8A and 8C, the second elastic member 220 may include a first region 242 that contacts the second assembly unit 120 and a second region 244 that contacts the light-emitting unit 150. The second region 244 may protrude from the first region 242 to maintain tension between the second elastic member 220 and the light-emitting unit 150. The second elastic member 220 may respectively contact the second assembly unit 120 and the light-emitting unit 150 and may maintain tension between the second assembly unit 120 and the light-emitting unit 150. The second elastic member 220 depicted in FIGS. 8B and 8C has an O-ring shape, but the shape of the O-ring is not limited thereto.

Referring to FIG. 8D, coil springs 250 may be formed between the second assembly unit 120 and the light-emitting unit 150. The second elastic member 220 depicted in FIGS. 8B and 8C has an O-ring shape. However, as depicted in FIG. 8D, the second elastic member 220 may be formed in a coil spring shape having one or more coil springs 250.

In FIG. 7A, the first elastic member 210 may be formed between the first step difference unit 14*a* and the first assembly unit 110 of the upper body 10, and in FIG. 8A, the second elastic member 220 may be formed between the light-emitting unit 150 and the second assembly unit 120. In an illumination device according to one or more embodiments, one of the first elastic member 210 and the second elastic member 220 may be optionally formed, or both of the first elastic member 210 and the second elastic member 220 may be formed.

Figure 9:
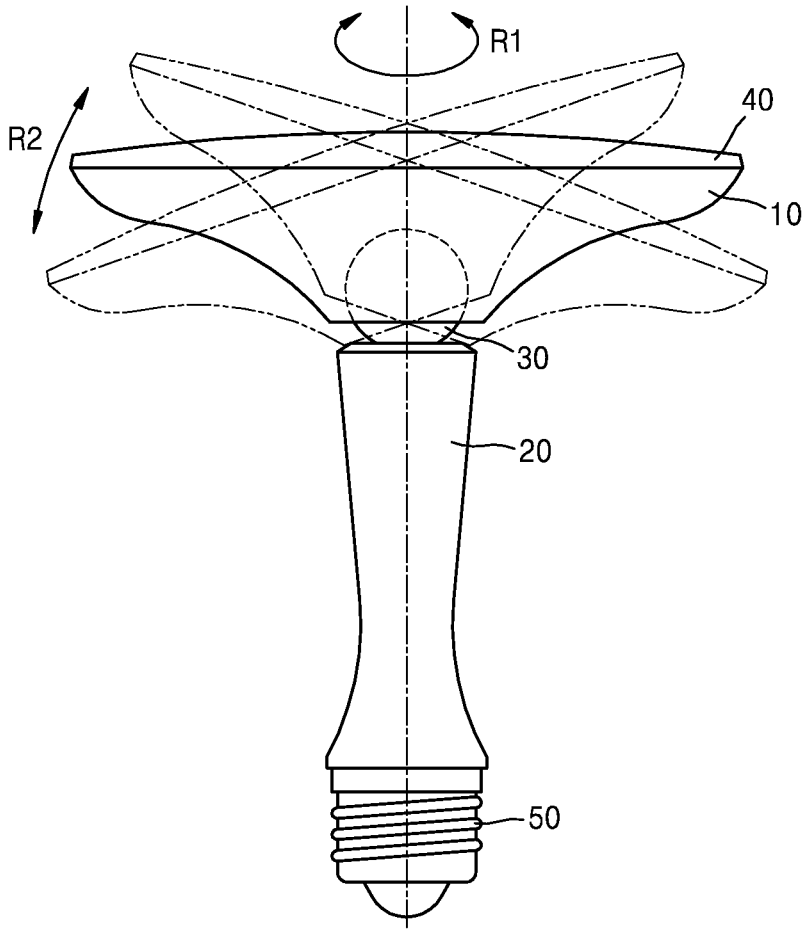
FIG. 9 is a schematic drawing illustrating an example of changing light emission directions of an illumination device according to one or more embodiments.

FIG. 9 is a schematic drawing illustrating an example of changing light emission directions of the illumination device according to one or more embodiments. Since the second assembly unit 120 may be coupled to the upper body 10, the direction conversion of the conversion unit 30 by the rotation of the second assembly unit 120 may denote the angular conversion of the upper body 10 and the light-emitting unit 150. As a result, according to one or more embodiments, the light emission direction of light emitted from the light-emitting unit 150 may be converted to the R1 direction and the R2 direction. Also, as depicted in FIGS. 4B and 4C, the conversion range of the emission direction of light emitted from the light-emitting unit 150 may be controlled by forming the step difference units 314, 324, and 326 or the protrusion units 312 and 322 and by forming the conversion control unit 122 on the second assembly unit 120.

As described above, the illumination device according to one or more embodiments may include the conversion unit 30 that may convert emission direction of light emitted from the light-emitting unit 150 therein, and the light emission direction may be controlled by forming the step difference units 314, 324, and 326 or the conversion control unit 122. In the illumination device described above, the user may control the light emission direction to a desired direction by controlling the upper body 10 after fixing the lower body 20 on an external structure. Also, the illumination device may have tension for maintaining an illumination angle.

The illumination device according to one or more embodiments may include a means for converting light emission direction, and thus, the emission direction of light emitted from a light-emitting unit may be arbitrary controlled.

Although a light emission direction conversion means according to one or more embodiments may not be installed on a structure on which the illumination will be mounted, the use of the illumination device according to the exemplary embodiment may control the emission direction of light emitted from a light-emitting unit.

In the illumination device according to one or more embodiments, tension for maintaining an illumination angle may be provided by forming an elastic member on or under the first assembly unit 110 and the second assembly unit 120.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

While one or more exemplary embodiments have been described with reference to the figures, it will be understood by those of ordinary skill in the art that various changes in form and details may be made therein without departing from the spirit and scope as defined by the following claims.

What is claimed is:

1. An illumination device, comprising:

an upper body on which a light-emitting unit that emits light is mounted;

a lower body that provides a power path to the light-emitting unit;

a conversion unit coupled to the lower body; and an assembly unit that assembles the conversion unit to the upper body such that the conversion unit converts an emission direction of light emitted from the light-emitting unit of the upper body, wherein the conversion unit comprises a ball-shaped main body unit, and wherein the conversion unit comprises a tap formed by extending from the main body unit, and the tap is coupled to the lower body.

2. The illumination device of claim 1, wherein, the assembly unit comprises a first assembly unit and a second assembly unit, and the first assembly unit and the second assembly unit each rotate in a state of surrounding and contacting the main body unit.

3. The illumination device of claim 2, wherein the main body unit comprises a ball-shaped upper main body and a ball-shaped lower main body, the lower main body has a radius of curvature that is larger than a radius of curvature of the upper main body, and a step difference unit is formed between the lower main body and the upper main body.

4. The illumination device of claim 3, wherein at least one conversion control unit that protrudes from the second assembly unit is formed on a lower surface of the second assembly unit, and the conversion control unit contacts or faces a surface of the upper main body.

5. An illumination device, comprising:

an upper body on which a light-emitting unit that emits light is mounted;

a lower body that provides a power path to the light-emitting unit;

a conversion unit coupled to the lower body; and an assembly unit that assembles the conversion unit to the upper body such that the conversion unit converts an emission direction of light emitted from the light-emitting unit of the upper body;

wherein the conversion unit comprises a ball-shaped main body unit, and wherein the main body unit comprises a ball-shaped upper main body and a ball-shaped lower main body, and at least one protrusion unit formed on the upper main body.

6. The illumination device of claim 2, wherein the main body comprises a first main body unit, a second main body unit, and a step surface unit formed between the first main body unit and the second main body unit.

7. The illumination device of claim 6, wherein at least one conversion control unit that protrudes from the second assembly unit is formed on a surface of the second assembly unit, and the conversion control unit contacts or faces the step surface unit.

8. The illumination device of claim 7, wherein at least one protrusion unit is formed on a surface of the step surface unit.

9. The illumination device of claim 2, wherein edge portions that protrude on both sides of the first assembly unit are supported by a first step difference unit of the upper body, and edge portions that protrude on both sides of the second assembly unit are supported by a second step difference unit of the upper body.

10. The illumination device of claim 9, wherein the second assembly unit and the second step difference unit of the upper body are coupled together by at least one assembling means.

11. The illumination device of claim 1, wherein the light-emitting unit is formed by mounting a plurality of diode chips on a substrate.

12. The illumination device of claim 1, wherein a cover unit is formed on the upper body, and the cover unit is formed of glass, a ceramic material, a resin of polycarbonate (PC) group, or a resin of polymethyl methacrylate (PMMA).

13. The illumination device of claim 2, wherein the upper body is formed as a housing structure having step differences so that the light-emitting unit and the first assembly unit and the second assembly unit are seated thereon.

14. The illumination device of claim 1, wherein the lower body comprises a socket unit to supply power to the light-emitting unit from the socket unit.

15. The illumination device of claim 2, wherein edge portions that protrude on both sides of the first assembly unit are supported by a step difference unit, and an elastic member is formed between the first assembly unit and the step difference unit.

16. The illumination device of claim 15, wherein the elastic member has an O-ring shape.

17. The illumination device of claim 2, further comprising an elastic member formed between the second assembly unit and the light-emitting unit.

18. The illumination device of claim 17, wherein the elastic member is formed as an O-ring.

19. The illumination device of claim 17, wherein the elastic member comprises at least one coil spring.

20. An illumination device, comprising:

a body on which a light-emitting unit that emits light is mounted;

a conversion unit on which the body is mounted such that the conversion unit converts an emission direction of light emitted from the light-emitting unit of the upper body;

a step surface unit being formed on a surface of the conversion unit; and a conversion control unit that protrudes from the body and contacts or faces the step surface unit to limit a movement of the conversion unit in a direction of the step surface unit, wherein the conversion unit includes a main body unit including a first main body and a second main body, and the step surface unit is formed between the first main body unit and the second main body unit.

21. The illumination device of claim 20, wherein the main body unit is ball-shaped.

22. The illumination device of claim 20, wherein the first main body unit has a radius of curvature that is larger than a radius of curvature of the second main body unit.

23. The illumination device of claim 22, further comprising at least one protrusion unit formed on the second main body to limit the movement of the conversion unit in a direction of the protrusion unit.

* * * * *